US005478233A

United States Patent [19]

Svensson

[11] Patent Number: 5,478,233

[45] Date of Patent: Dec. 26, 1995

[54] POT BURNER FOR LIQUID FUEL

[75] Inventor: Kent Svensson, Kristdala, Sweden

[73] Assignee: Kent Svensson, Kristdala, Sweden

[21] Appl. No.: 290,861

[22] PCT Filed: Mar. 1, 1993

[86] PCT No.: PCT/SE93/00179

§ 371 Date: Aug. 22, 1994

§ 102(e) Date: Aug. 22, 1994

[87] PCT Pub. No.: WO93/17278

PCT Pub. Date: Sep. 2, 1993

[30] Foreign Application Priority Data

Feb. 28, 1992 [SE] Sweden ..... 9200622

[51] Int. Cl.[6] ..... F23D 5/02

[52] U.S. Cl. ..... 431/338; 431/340; 431/342; 431/262

[58] Field of Search ..... 431/338, 340, 431/342, 260, 262, 261

[56] References Cited

U.S. PATENT DOCUMENTS

| | | | |
|---|---|---|---|
| 2,351,481 | 6/1944 | Breese | 431/340 |
| 2,483,978 | 10/1949 | Little | 431/260 |
| 2,710,652 | 6/1955 | Ambrose | 431/262 |
| 3,017,925 | 1/1962 | Breeze et al. | 431/340 |

*Primary Examiner*—Carroll B. Dority
*Attorney, Agent, or Firm*—Dowell & Dowell

[57] ABSTRACT

A burner for combusting vaporized liquid fuel includes a combustion chamber which is open at an upper end and a side wall which defines air supply openings through which air is delivered into the combustion chamber. A thermally conductive body is disposed in the combustion chamber and extends upwards to the upper end of the chamber. The body enhances the combustion of the fuel within the combustion chamber. A disk-shaped annulus defining gas flow openings is mounted in the combustion chamber and extends radially inwards from the side wall to proximate the body, such that substantially all gas flow past the annulus occurs through the gas flow openings.

20 Claims, 2 Drawing Sheets

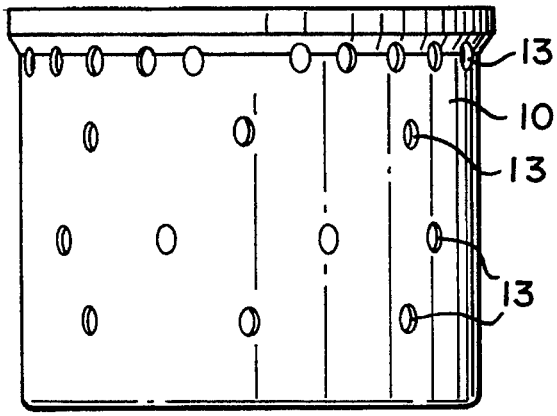
FIG. 3
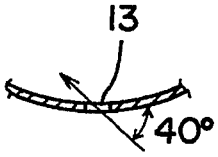
FIG. 7A
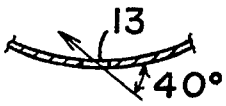
FIG. 7B
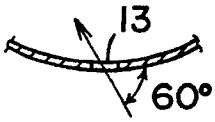
FIG. 8
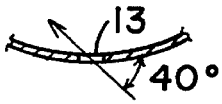
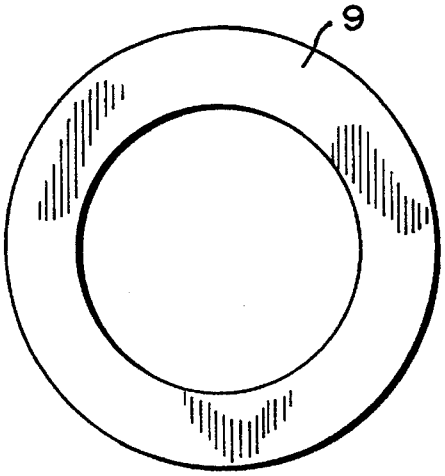
FIG. 4
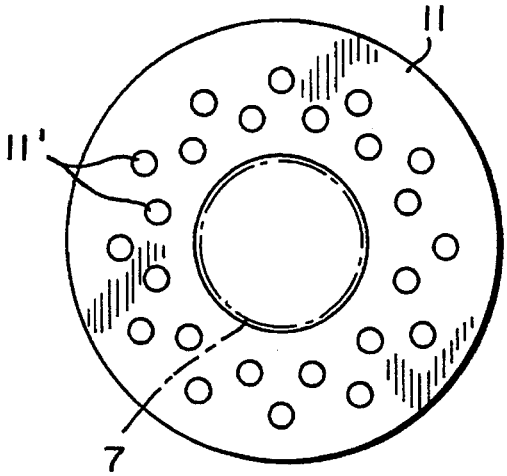
FIG. 5
FIG. 6
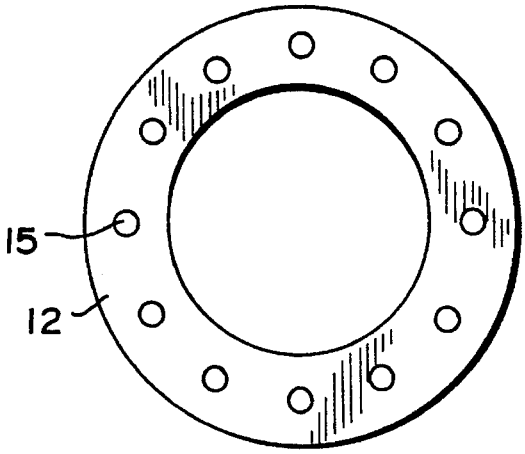

POT BURNER FOR LIQUID FUEL

BACKGROUND OF THE INVENTION

The present invention relates to a burner for burning vapourized liquid fuel, such as diesel oil, which is intended to be introduced into a preferably, essentially cylindrical combustion chamber through a fuel delivery inlet, which is preferably located at the bottom of the burner, the combustion chamber being open at its end opposite to the bottom of the burner. The burner includes ignition means, such as an ignition coil, for initial ignition of vapourized fuel, and the combustion chamber includes holes through which air of combustion is delivered to the combustion chamber, in which at least one essentially disk-shaped annulus or the like extends peripherally around the combustion chamber and extends radially inwards from the wall of the chamber.

Burners of this general kind are known to the art. One problem of burners of this kind resides in effectively vapourizing the fuel, which is normally delivered at a predetermined rate of flow per unit of time and will thus accumulate in the combustion chamber if not vapourized. Another problem resides in achieving an effective mixture of vapourized fuel and combustion air, so as to achieve complete combustion in the absence of soot formations. Still another problem is one of achieving quiet combustion in the absence of pulsations.

SUMMARY OF THE INVENTION

The present invention provides a burner with which these problems are solved in a very simple and effective manner. The burner also includes complementary constructive features, which result in a highly effective and operationally reliable burner.

The invention thus relates to a burner for burning vapourized liquid fuel, such as diesel oil, which comprises a preferably cylindrical combustion chamber to which fuel is delivered through a chamber inlet, preferably located at the bottom of the chamber, the chamber being open at the end opposite to said bottom, and further comprising an ignition means, such as an ignition coil, for initial ignition of vapourized fuel, and wherein holes are provided in the combustion chamber for the delivery of air of combustion thereto, and wherein the combustion chamber includes at least one essentially disk-shaped annulus or the like which extends circumferentially around the combustion chamber and projects radially inwards from the chamber wall.

The burner is mainly characterized in that at least one body is placed preferably centrally in the combustion chamber and extends from the bottom of the chamber to an upper part thereof and functions to assist in achieving complete combustion of the fuel delivered to the chamber.

BRIEF DESCRIPTION OF THE DRAWINGS

The invention will now be described in more detail with reference to exemplifying embodiments thereof and also with reference to the accompanying drawings, in which

FIG. 3 is a side view of an upper part of a cylindrical, basin-shaped body which forms the upper part of the combustion chamber;

FIG. 4 illustrates a first embodiment of an annulus, as seen from above in FIG. 1;

FIG. 5 illustrates another embodiment of an annulus, as seen from above in FIG. 1; and FIG. 6 illustrates a third embodiment of an annulus, as seen from above in FIG. 1;

FIGS. 7A–7C illustrate the orientation of the respective levels of holes provided in the wall of the combustion chamber; and FIG. 8 illustrates another orientation of the holes provided in the wall of the combustion chamber.

DETAILED DESCRIPTION OF THE PREFERRED EMBODIMENT

Figure 1:
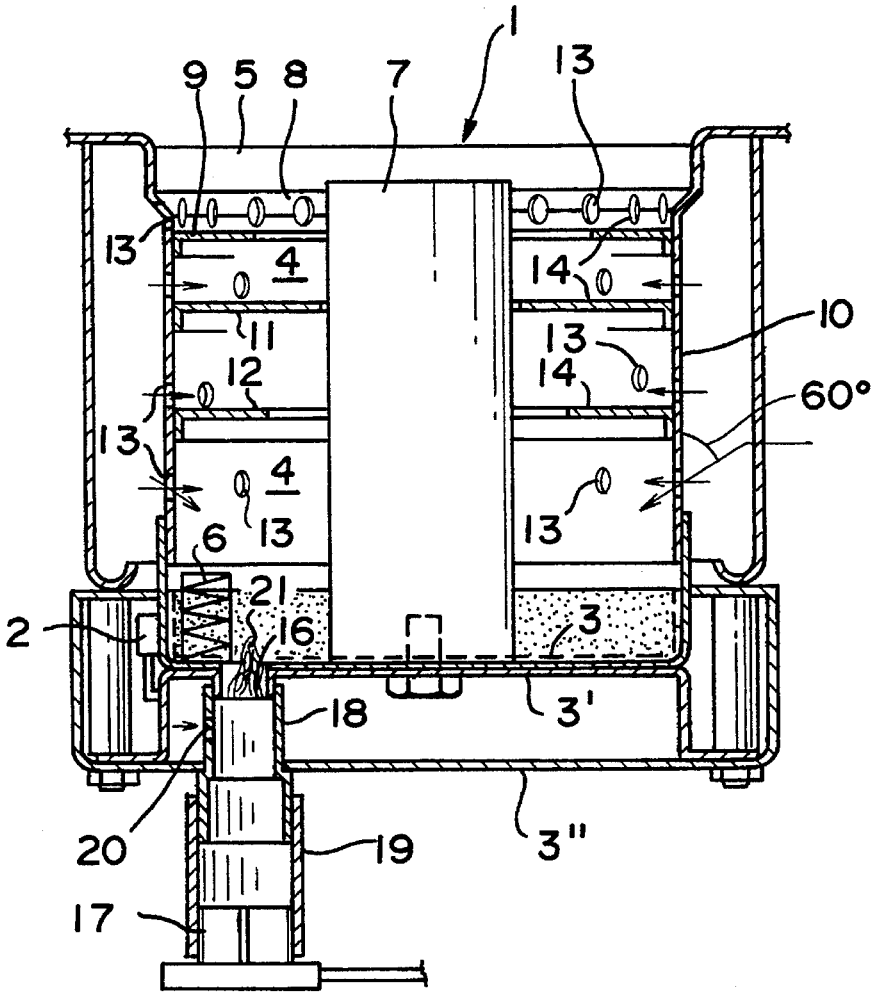
FIG. 1 is a vertical, schematic central sectional view of a first embodiment of an inventive burner.
Figure 2:
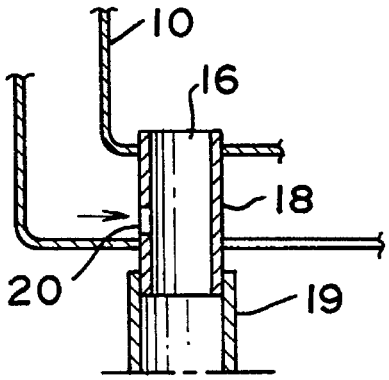
FIG. 2 illustrates schematically part of an alternative construction of the burner in the vicinity of a burner flame monitor.

Shown in FIG. 1 is a burner 1 for burning vapourized liquid fuel, such as diesel oil. The burner includes an inlet 2, which in the illustrated case is located at the bottom 3 of a preferably cylindrical combustion chamber 4, wherein fuel is introduced into the burner through the inlet 2. The combustion chamber 4 is open at the end 5 thereof opposite to the bottom 3, and an ignition means 6, such as an ignition coil, is provided for initial ignition of vapourized fuel. As described in more detail herebelow, the combustion chamber is provided with holes through which air of combustion is delivered to the chamber.

The illustrated burner also includes a body 7 which is preferably mounted centrally in the combustion chamber 4 and which extends from the chamber bottom 3 to an upper part 8 of the combustion chamber, such as to screen-off a preferably central part of the combustion chamber. In appropriate cases, the body is made of a material which possesses relatively good thermal conductivity, so that an even and high combustion temperature is obtained under high turbulence for mixing vapourized fuel with the air of combustion.

The reference numeral 9 in FIG. 1 identifies a first essentially disk-shaped annulus which extends circumferentially around the combustion chamber and projects radially inwards from the wall 10 thereof. The annulus 9 is mounted in the upper part 8 of the combustion chamber, the part forming the combustion zone, and extending around the body 7 such as to define a space between the body and the annulus. The reference numerals 11 and 12 identify annuli which are mounted beneath the first annulus 9 and which also surround the body 7.

At least one preferably disk-shaped annulus 11 or corresponding device, FIG. 5, in this case the annulus 11, extends radially inwards from the wall 10 of the combustion chamber up to or essentially up to the body 7, so as to partition off the combustion chamber at a given level, preferably at a level substantially above the center of the vertical axis of the chamber. The annulus 11 is provided with holes 11' through which gas is intended to pass, wherein the illustrated embodiment includes two rings of circumferentially disposed holes, i.e. an outer ring and an inner ring.

The burner further includes a ring of holes 13 through which air of combustion is delivered to the burner and which are located in the vicinity of preferably each annulus 9, 11, 12 and at least in the vicinity of the first annulus 9. Each ring of holes is preferably arranged above respective annuli in the immediate vicinity of the upper surface 14 thereof. At least some, and preferably all holes 13, with the exception of the holes of the first ring of holes, of respective rings extend horizontally, but not radially, at a given inlet angle, preferably about 40°, to the tangential direction of the wall of the combustion chamber, as shown in FIG. 7 in the vicinity of the level of each annulus.

At least the ring of holes 13 which lies nearest the bottom of the combustion chamber includes certain holes, for instance each alternate hole, which define a given inlet angle, preferably an angle of about 60°, with a horizontal plane which extends transversely to the vertical axis of the combustion chamber (FIG. 8).

According to one preferred embodiment of the invention, the annulus 12 has a circle of holes 15 which extend circumferentially therearound, as illustrated in FIG. 6. The burner is preferably provided in the bottom 3 with an opening 16 which is preferably located adjacent the wall 10 of the chamber and through which opening a flame-monitoring detector 17, such as an infrared detector, is able to detect whether the burner is ignited or not. In the illustrated embodiment, a pipe 18 or like conduit extends vertically downwards from the bottom opening 16 to the vicinity of the detector 17, via a connecting pipe 19, the pipe 18 passing through both bottom parts 3', 3" of the illustrated burner. The reference numeral 20 identifies an aperture which is located adjacent the bottom opening 16 and which is formed in the pipe 18 beneath the bottom layer 3' for delivering air to a pilot flame, the status of which is detected by the detector device.

The bottom 3 of the combustion chamber will preferably slope inwardly towards the centre of the chamber, so that non-vapourized fuel will collect in the centre of the burner. It is also preferred to deliver fuel to the vicinity of the bottom 3, preferably in the vicinity of the flame-monitor opening 16.

According to one preferred embodiment illustrated in the accompanying drawings, three disk-shaped annuli are located at mutually different levels in the combustion chamber. The aforesaid body 7 has a diameter of about 30 mm and the internal diameter of the combustion chamber is about 65 mm. The central hole or throat diameter of the first annulus is about 45 mm, while the throat diameter of the lowermost ring is about 40 mm. The center annulus 11 of the illustrated embodiment extends to the immediate vicinity of the body 7. The ring of holes provided in the immediate vicinity of the first annulus includes about 24 holes, each having a diameter of 2.5 mm. The ring of holes provided in the immediate vicinity of the center annulus 11 includes about 48 holes, each having a diameter of 1.5 mm, whereas the ring of holes provided in the immediate vicinity of the annulus 12 comprises 8 holes, each having a diameter of 1.6 mm. Located beneath the lowermost annulus is a ring of about 8 holes, each of which has a diameter of about 1.5 mm and each alternate hole is directed downwards. The bottom ring of holes is located about 21 mm from the bottom 3 of the combustion chamber, and the annuli are located respectively about 33.5, about 47 and about 56.5 mm from the bottom 3.

The manner in which the inventive burner operates will be understood essentially from the aforegoing. Fuel is introduced at the bottom of the burner and is vapourized and mixed effectively with air delivered through the holes. Angling of the holes results in an effective mixture and extends the stay time. The fuel/air mixture is ignited and burns effectively in the upper part of the combustion chamber, the upper part forming the main combustion zone. The body 7 screens-off a central part of the combustion chamber, although combustion will not normally occur in this central region of the combustion chamber to any great extent, and combustion will be concentrated to more peripheral regions of the combustion chamber where a plentiful supply of oxygen is found. The body 7 also has a heat storage effect and ensures that a uniform, high temperature is obtained throughout the whole of the combustion chamber. The body is also able to transfer heat to the bottom region of the combustion chamber. The body therewith ensures complete combustion of the fuel delivered to the burner.

The annulus 11 which extends to the immediate vicinity of the body and through which gas will pass solely, or essentially solely, through the holes 11' provided in the annulus 11, produces an oscillation-damping or pulsation-damping effect with regard to combustion and gas flow, since velocity gradients in the gas flow are quickly equalized through the holes 11' in the annulus and as a result of the pressure drop caused by the holes. The resistance offered by the holes to the gas flow increases rapidly with the velocity of the gas. The annulus also provides a temperature-maintaining and temperature-equalizing effect with regard, among other things, to that part of the combustion chamber which is located beneath the annulus, and improves vapourization of the fuel and the fuel/air mixture in addition to ensuring a high gas and flame temperature. The annulus thus contributes towards complete and effective combustion.

The pilot flame ensures that the burner flame can actually be detected, which is not always the case when needing to detect combustion in the upper part of the combustion chamber. As a result of the temperature-maintaining effect of the annulus 11 and the body 7 and because of the downwardly directed holes in the lower ring of holes, a high temperature and an effective mixture is obtained in the vicinity of the bottom 3, so as to ensure that the pilot flame will be ignited, the ignition device 6 preferably being located in the vicinity of the opening 16.

It will be evident from the aforegoing that the invention provides important improvements to the known technique.

Although the invention has been described with reference to preferred exemplifying embodiments thereof, it will be understood that other embodiments are conceivable and that minor changes and modifications can be made without departing from the concept of the invention.

It is often preferred to place the body 7 centrally and to use a cylindrical body which is made of sheet metal, such as steel sheet. The body 7 may be solid and is conveniently screwed firmly to the bottom 3 from beneath. It is also conceivable to use more than one body. Alternatively, the body, or bodies, may be made of a ceramic material.

The lower edges of the holes may be located adjacent the upper side of respective annuli.

Although it is preferred to include three annuli in the burner, it will be understood that the number of annuli provided may be fewer or more than has been shown, for instance solely the annulus 11 may be provided.

The bottom 3 is preferably clad with fiberglass fabric, which may also extend slightly up along the wall 10 from the bottom 3, as indicated in FIG. 1.

I claim:

1. A burner for burning vaporized liquid fuel, comprising:

a cylindrical shaped combustion chamber including a side wall defining air supply openings and an open upper end;

a fuel supply inlet disposed at said lower end;

ignition means disposed at said lower end for igniting vaporized fuel supplied through said fuel supply inlet;

an upstanding body disposed in the combustion chamber; and a first substantially disk-shaped annulus extending radially inwards from said side wall of the combustion chamber to proximate said body so as to substantially close-off the space between an inner periphery of said disk-shaped annulus and said upstanding body from the flow of gases, the first annulus defining a plurality of gas flow openings such that substantially all gases passing through the first annulus flow through said gas flow openings.

2. The burner of claim 1, wherein the combustion chamber comprises a bottom wall and said body is centrally positioned on said bottom wall.

3. The burner of claim 1, wherein said side wall of the combustion chamber defines a plurality of circularly spaced air supply openings disposed above and adjacent to the first annulus.

4. The burner of claim 1, comprising a second substantially disk-shaped annulus mounted at said upper end of the combustion chamber above the first annulus, said second annulus extends radially inwards from said side wall so as to define a flow space between the second annulus and said body.

5. The burner of claim 3, comprising a second substantially disk-shaped annulus mounted at said upper end of the combustion chamber above the first annulus, said second annulus extends radially inwards from said side wall so as to define a flow space between the second annulus and said body.

6. The burner of claim 5, wherein said side wall of the combustion chamber defines a plurality of circularly spaced air supply openings disposed above and adjacent to the second annulus.

7. The burner of claim 4, comprising a third substantially disc-shaped annulus mounted below the first annulus and extending radially inwards from said side wall of the combustion chamber so as to define a flow space between the third annulus and said body.

8. The burner of claim 6, comprising a third substantially disc-shaped annulus mounted below the first annulus and extending radially inwardly from said side wall of the combustion chamber so as to define a flow space between the third annulus and said body.

9. The burner of claim 8, wherein said side wall of the combustion chamber defines a plurality of circularly spaced air supply openings disposed above and adjacent to the third annulus, and a plurality of circularly spaced air supply openings disposed below the third annulus.

10. The burner of claim 1, wherein a number of the air supply openings extend horizontally and form an inlet angle of about 40° with respect to a tangential direction of said side wall of the combustion chamber.

11. The burner of claim 9, wherein a number of the air supply openings disposed above and adjacent to the first annulus, the second annulus and the third annulus extend horizontally and form an inlet angle of about 40° with respect to a tangential direction of said side wall of the combustion chamber.

12. The burner of claim 11, wherein a number of the air supply openings disposed below the third annulus form an inlet angle of about 40° with respect to a tangential direction of said side wall of the combustion chamber and are directed downwards so as to form an angle of about 60° with respect to a plane extending transversely to a vertical axis of the combustion chamber.

13. The burner of claim 7, wherein the second annulus and the third annulus each define a plurality of circularly spaced gas flow openings intermediate said outer wall of the combustion chamber and said body.

14. The burner of claim 1, wherein the combustion chamber comprises a bottom wall defining a bottom opening, and said burner further comprises a flame detector for detecting the ignition of said burner through said bottom opening.

15. The burner of claim 14, wherein said flame detector is housed in a conduit which extends downwards from said bottom opening and defines a flame monitoring opening, and said fuel supply inlet being disposed adjacent to said flame monitoring opening.

16. The burner of claim 15, comprising an air passage located adjacent said bottom opening of said bottom wall for supplying air to sustain a pilot flame, said flame detector being adapted to monitor said pilot flame.

17. The burner of claim 14, wherein said bottom wall of said combustion chamber is sloped downwards so that vaporized fuel collects at said bottom wall.

18. The burner of claim 2, wherein said body is cylindrical shaped and composed of a thermally conductive material.

19. A burner for burning vaporized liquid fuel, comprising:

a combustion chamber including a side wall defining a plurality of air supply openings, a lower end and an open upper end;

a thermally conductive body disposed in the combustion chamber and extending upwardly from said lower end to said upper end;

a first horizontal wall extending inwards from said side wall of the combustion chamber to proximate said body so as to substantially close-off the space between an inner periphery of said first horizontal wall and said thermally conductive body from the flow of gases, the first wall defining a plurality of gas flow openings such that substantially all gases passing through the first wall flow through the gas flow openings;

a second horizontal wall mounted at said upper end of the combustion chamber above the first annulus, the second wall extending radially inwards from said side wall so as to define a flow space between the second wall and said body; and a third horizontal wall mounted below the first annulus and extending radially inwards from said side wall of the combustion chamber so as to define a flow space between the third wall and said body.

20. A burner for burning vaporized liquid fuel, comprising:

a combustion chamber including a side wall, a lower end and an open upper end, said side wall defining a plurality of circularly spaced air supply openings extending horizontally and forming an inlet angle of about 40° with respect to a tangential direction of said side wall;

a fuel supply inlet disposed at said lower end;

ignition means disposed at said lower end for igniting vaporized liquid fuel supplied through said fuel supply inlet;

a thermally conductive body disposed in the combustion chamber and extending upwardly from said lower end to said upper end;

a first substantially disk-shaped wall extending inwardly from said side wall of the combustion chamber to proximate said body to substantially close-off the space between an inner periphery of said first disc-shaped wall and said thermally conductive body from the flow of gases, the first wall defining a plurality of gas flow openings such that substantially all gases passing through the first wall flow through the gas flow openings;

a second substantially disk-shaped wall mounted at said upper end of the combustion chamber above the first wall, the second wall extending radially inwards from said side wall so as to define a floor space between the second wall and said body;

a third substantially disk-shaped wall mounted below the first wall and extending radially inwards from said side wall of the combustion chamber so as to define a flow space between the third wall and said body;

said side wall of the combustion chamber defining a plurality of circular spaced air supply openings disposed below the third wall and forming an inlet angle of about 40° with respect to the tangential direction of said side wall and being directed downwards so as to form an angle of about 60° with respect to a plane extending transversely to a vertical axis of the combustion chamber; and a flame detector disposed at said lower end of the combustion chamber for detecting ignition of said burner.

* * * * *